US006325480B1

(12) United States Patent
Moghadam et al.

(10) Patent No.: US 6,325,480 B1
(45) Date of Patent: Dec. 4, 2001

(54) INK JET PRINTER AND METHOD CAPABLE OF FORMING A PLURALITY OF REGISTRATION MARKS ON A RECEIVER AND SENSING THE MARKS FORMED THEREBY

(75) Inventors: Omid A. Moghadam, Pittsford; Gilbert A. Hawkins, Mendon; David L. Jeanmaire, Brockport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/123,689

(22) Filed: Jul. 28, 1998

(51) Int. Cl.[7] ..... B41J 29/38; B41J 29/393
(52) U.S. Cl. ..... 347/19; 347/5
(58) Field of Search ..... 347/19, 16, 44, 347/47

(56) References Cited

U.S. PATENT DOCUMENTS

| | | | | |
|---|---|---|---|---|
| 3,763,356 | * | 10/1973 | Berler | 235/61.12 |
| 4,437,403 | | 3/1984 | Greiner . | |
| 4,495,583 | | 1/1985 | Punster . | |
| 4,496,955 | | 1/1985 | Maeyama et al. . | |
| 4,596,468 | | 6/1986 | Simeth . | |
| 4,839,674 | * | 6/1989 | Hanagata et al. | 347/19 |
| 4,994,975 | | 2/1991 | Minschart . | |
| 5,313,886 | | 5/1994 | Muller . | |
| 5,375,243 | | 12/1994 | Parzych et al. . | |
| 5,434,956 | | 7/1995 | Son et al. . | |
| 5,682,475 | | 10/1997 | Johnson et al. . | |
| 5,708,777 | | 1/1998 | Sloan et al. . | |
| 5,929,432 | * | 7/1999 | Yamakawa | 250/208.1 |
| 6,102,513 | * | 8/2000 | Wen | 347/47 |

FOREIGN PATENT DOCUMENTS

| | | |
|---|---|---|
| 0 842 784 A | 5/1998 | (EP) . |
| 09 123544 A | 5/1997 | (JP) . |

* cited by examiner

*Primary Examiner*—John Barlow
*Assistant Examiner*—An H. Do
(74) *Attorney, Agent, or Firm*—Norman Rushefsky

(57) ABSTRACT

An ink jet printer and method capable of forming a plurality of registration marks on a receiver and sensing the marks formed thereby. The method includes a print head for printing an image of predetermined length on the receiver. The receiver has an image area for receiving the image therein and a border area adjacent to the image area. A marker forms the plurality of registration marks in the border area, so that the marks extend the length of the image. In addition, a sensor is disposed in sensing relationship to the marks for sensing the marks. The invention provides a combination marker for marking a receiver and a sensor for sensing the marks so that each image line is in registration with other lines of the image. Also, use of the invention avoids need for costly precision motors to advance the receiver during printing of image lines.

34 Claims, 4 Drawing Sheets

INK JET PRINTER AND METHOD CAPABLE OF FORMING A PLURALITY OF REGISTRATION MARKS ON A RECEIVER AND SENSING THE MARKS FORMED THEREBY

BACKGROUND OF THE INVENTION

This invention generally relates to ink jet printers and methods therefor and more particularly relates to an ink jet printer and method capable of forming a plurality of registration marks on a receiver and sensing the marks formed thereby to precisely translate the receiver in a manner avoiding use of a precision motor.

Ink jet printing is a popular technique for printing color images. The advantages of nonimpact printing, low noise, low energy use, low cost of operation, avoidance of toner transfers and fixing, and the ability to print on plain paper receiver are largely responsible for wide acceptance of ink jet printing in the marketplace.

In this regard, an ink jet printer produces text and color images on a receiver by ejecting ink droplets of cyan, magenta, yellow and black onto the receiver in an image-wise fashion. The different lines of the image are each deposited in separate printing passes, so that each printing pass forms one or more individual lines of an image. Combination of the lines forms the complete color print after all lines have been printed. It is known that such ink jet print heads can take any one of several forms including piezo-electric ink jet, thermal ink jet, and so-called "BUBBLE JET"™ ink jet.

Moreover, a typical ink jet printer includes a print head translatable in a first direction and a plurality of rollers for translating the receiver in a second direction orthogonal to the first direction. As the print head and receiver are translated, the color image is printed onto the receiver in a series of image bands, which typically overlap, each band corresponding to dots printed in a single scan of the print-head in the first direction. That is, as the print head is translated in the first direction, a predetermined amount of ink is ejected at selected locations in order to print an image band. At this point, the rollers are operated typically by means of a precision motor, such as a stepper motor, to translate the receiver in order to print another image band. In this manner, a color image is printed consisting of a plurality of rows of printed dots (image rows) along the first direction. After printing of the image, the receiver is then ejected from the printer to receive the next sheet of receiver for printing another image.

However, it is important that individual image bands be in alignment (i.e., in registration) with each other in order to provide an aesthetically pleasing print. Indeed, each image band is expected to be in registration to only a few micro meters with neighboring image bands. Registration is conventionally provided by the use of the precision motor which advances the receiver during the printing process in steps after each pass of the ink jet printhead.

In the color impact printing art, use of registration marks to align separate color planes of an image (cyan, magenta, yellow and black) is known. These registration markers indicate the start and end of the image in each color plane. Reference is made to these marks as separate color planes are printed, so that individual color planes are in registration. In this regard, a registration mark is a symbol or collection of marks, such as a bar code, which convey information to the printer about the receiver. Such registration marks may be produced using optical, magnetic, electrical, tactile or other method that is easily readable.

Use of registration marks to achieve registration of color planes is known. One such technique is disclosed in U.S. Pat. No. 5,434,956 titled "Method And Apparatus For Printing An Image In A Specified Positional Relationship With A Preprinted Registration Mark" issued Jul. 18, 1995 in the name of Myungsae Son, et al. In one embodiment of the Myungsae Son et al. device, an image is preprinted on a receiver in a known positional relationship with a two-dimensional registration mark. A new image is printed onto the same receiver as the preprinted image. These plural images, such as the several related images produced in a multicolor drawing, are aligned with each other according to the registration mark in order to achieve proper registration. However, this patent does not address the problem of controlling the movement of the printhead in relation to the receiver during the printing process, and only solves the problem of locating the registration mark that is used as a reference for aligning different portions or planes of an image.

As stated hereinabove, the receiver is typically translated with respect to the print head by a stepper motor to achieve accurate registration of the image rows. For example, an apparatus and method using a stepper motor for encoding positions of a web press is disclosed in U.S. Pat. No. 4,495,583 titled "Apparatus And Method For Encoding Positions Of Web Press Machines" issued Jan. 22, 1985 in the name of Dinesh G. Punater. This patent discloses an apparatus and method for encoding lateral setting within a web press that operates on a web. The apparatus may be any laterally adjustable machine for operating on the web, such as an imprinter, numbering unit, or a device for punching or perforating the web. The machine is mounted on a shaft for movement along the shaft. A stepper motor is connected to the shaft for rotating the shaft in order to provide pre-encodement alignment of the machine with respect to the web. However, stepper motors are costly and cumbersome, especially when the printer assembly is designed to be used as part of a compact portable device such as a digital camera. Therefore, another problem in the art is use of costly precision motors either for translation of the receiver or for movement of a machine that encodes a web press.

Therefore, there has been a long-felt need to provide an ink jet printer and method capable of forming a plurality of registration marks on a receiver and sensing the marks formed thereby to precisely translate the receiver in a manner avoiding use of a precision motor.

SUMMARY OF THE INVENTION

An object of the present invention is to provide an ink jet printer and method capable of forming a plurality of registration marks on a receiver and sensing the marks formed thereby to precisely translate the receiver in a manner avoiding use of a precision motor.

With this object in view, the invention resides in an ink jet printer capable of forming a plurality of registration marks on a receiver and sensing the marks formed thereby, comprising a print head for printing an image of predetermined length on the receiver, the receiver having an image area for receiving the image therein and a border area adjacent to the image area; a marker disposed near the print head for forming the plurality of registration marks in the border area, the marks extending the length of the image; and a sensor disposed near the print head and in sensing relationship to the marks for sensing the marks.

According to an embodiment of the invention, the printer comprises a print head for printing an image of predetermined length on the receiver. The receiver has an image area for receiving the image therein and a border area adjacent to the image area. A marker forms the plurality of registration marks in the border area, so that the marks extend the length of the image. In addition, a sensor is disposed in sensing relationship to the marks for sensing the marks. The invention provides a combination marker for marking a receiver and a sensor for sensing the marks so that each image line is in registration with other lines of the image. Also, use of the invention avoids need for costly precision motors to advance the receiver during printing of image lines.

A feature of the present invention is the provision of a printer having a combination marker for marking a receiver and a sensor for sensing the marks made by the marker during printing of a first line of a color image, so that subsequent image lines are capable of being in registration with the first line; however, without use of costly precision motors that advance the receiver during printing of individual image lines.

An advantage of the present invention is that the printer provides the dual function of both marking the receiver and sensing the marks made on the receiver, in order to achieve proper registration of image lines.

Another advantage of the present invention is that use of a costly precision motor to translate the receiver is avoided. This advantage allows one to design compact and portable printing devices, such as an on-board printer with a digital camera, without using an extra precision motor to translate the receiver.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
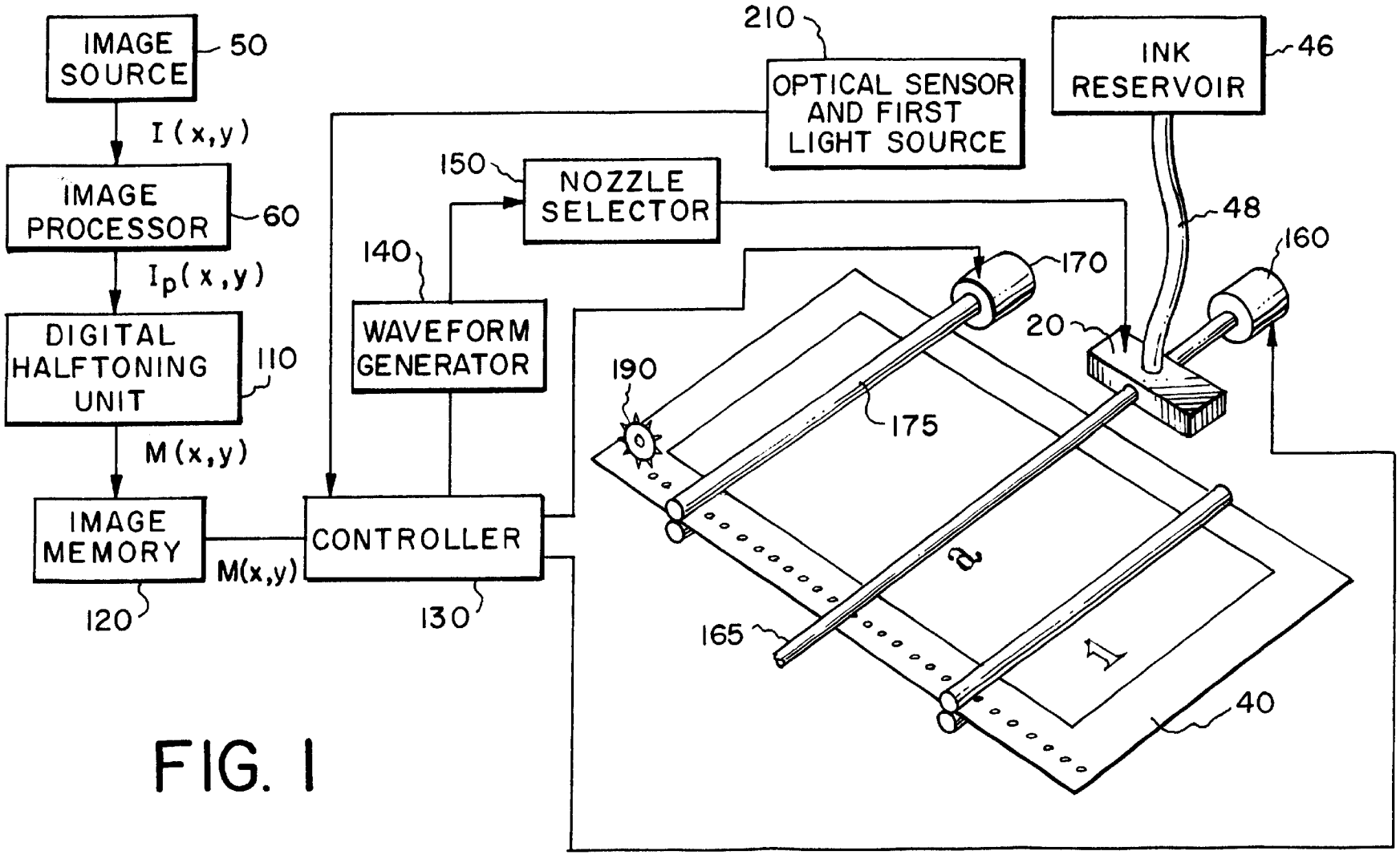
FIG. 1 illustrates a printer according to the present invention, the printer having a print head for printing an image on a receiver.
Figure 2:
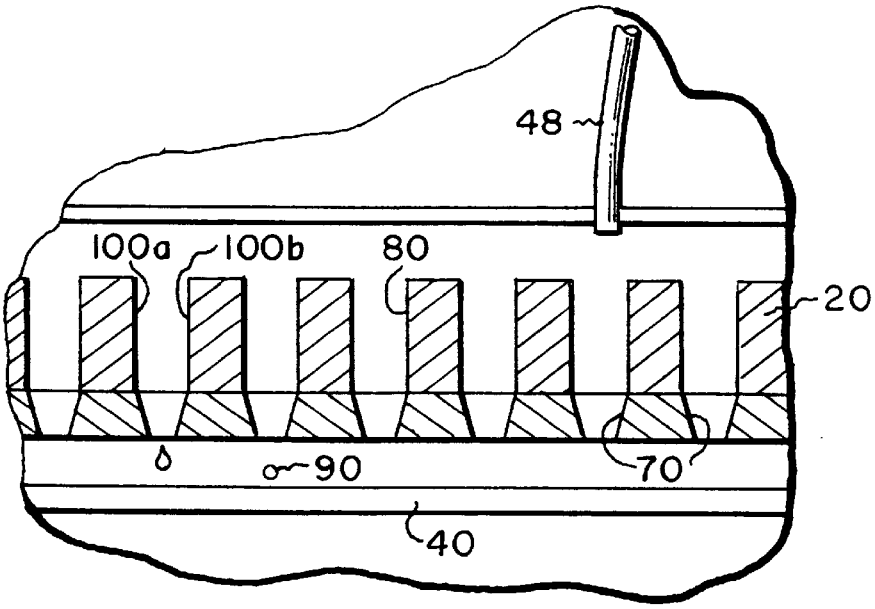
FIG. 2 is a fragmentation view in vertical section of the print head, the print head having a plurality of nozzles ejecting a plurality of ink droplets to be deposited on the receiver.
Figure 3:
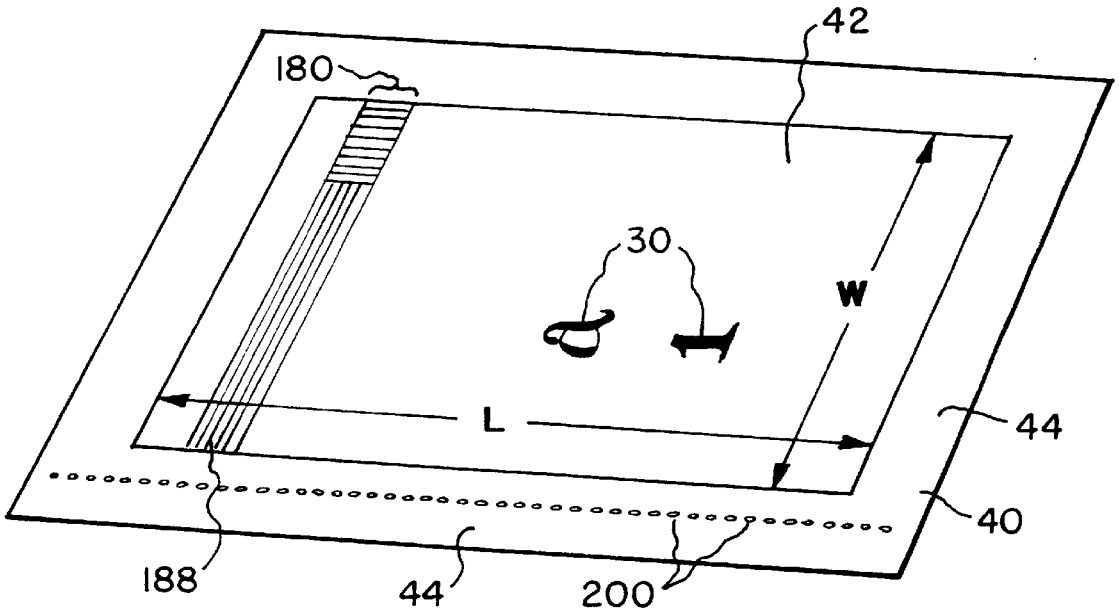
FIG. 3 is a view in perspective of the receiver, the receiver having registration marks thereon.

Therefore, referring to FIGS. 1, 2 and 3, there is shown an ink jet printer, generally referred to as 10. Printer 10 includes a print head 20 for printing a plurality of image bands forming a color image 30 on a receiver 40. Receiver 40 includes an image area 42 of a predetermined length "L" and width "W" and further includes a border area 44 surrounding image area 42, for reasons disclosed hereinbelow. Also, print head 20 may be any one of several known print head types, such as a piezoelectric ink jet print head, or a thermal ink jet print head, or a so-called "BUBBLE JET"™ ink jet print head. "BUBBLE JET" is a trademark of Canon Inc. located in Tokyo, Japan. An ink reservoir 46 is in fluid communication with each chamber 80, such as by a conduit 48, for supplying ink to each chamber 80.

As best seen in FIG. 1, printer 10 includes an image source 50 having a digital input image file I(x,y) stored therein. With respect to input image file I(x,y), the letters "x" and "y" designate column and row numbers, respectively, the combination of which define individual pixel locations in an input image. More specifically, a plurality of color pixels with a color pixel value at each "x" and "y" location will preferably correspond to pixels having desired color densities when printed on receiver 40. Image file I(x,y) may be generated by a computer or, alternatively, provided as an input generated from a magnetic disk, a compact disk, a memory card, a magnetic tape, a digital camera, a print scanner, a film scanner, or the like. Moreover, image file I(x,y) may be provided in any suitable format well known in the art, such as page-description language, or bitmap formats.

Referring to FIGS. 1 and 2, electrically connected to image source 50 is an image processor 60, which processes image file I(x,y) by performing any one of several desired operations on image file I(x,y). These operations, for example, may be decoding, decompression, rotation, resizing, coordinate transformation, mirror-image transformation, tone scale adjustment, color management, in addition to other desired operations. Image processor 60 in turn generates an output image file $I_p(x,y)$, which includes a plurality of pixel values having color code values, the pixel values respectively corresponding to a plurality of ink delivery nozzles 70 (only seven of which are shown) integrally connected to print head 20. Each nozzle 70 defines an ink chamber 80 therein capable of ejecting an ink droplet 90 therefrom. In order to eject ink droplet 90, a pair of oppositely disposed sidewalls 100*a* and 100*b* line chamber 80. Sidewalls 100*a* and 100*b* are capable of lateral movement in response to electrical stimuli applied thereto. In this regard, sidewalls 100*a* and 100*b* define an electromechanical transducer, which may be a piezoelectric transducer made of lead zirconium titanate (PZT), that is responsive to the electrical stimuli for inducing lateral movement of sidewalls 100*a* and 100*b*. Moreover, a heater (not shown) may be in heat transfer communication with ink in chamber 80 for reducing surface tension of the ink by supplying heat to the ink, so that ink droplet 90 can be more easily ejected from nozzle 70.

Referring to FIG. 1, an image halftoning unit 110 is used to minimize undesirable artifacts (e.g., contouring and noise) in printed image 30. As used herein, the terminology "image halftoning" refers to the image processing technique which creates the appearance of intermediate tones by the spatial modulation of two tones, for example, black and white, or multiple levels of tones, such as black, white and gray levels. Thus, halftoning improves image quality by minimizing image artifacts such as contouring and noise. In this regard, halftoning unit 110 produces a halftoned image file M(x,y).

Referring yet again to FIG. 1, halftoned image file M(x,y) is next sent to an image memory 120. Image memory 120 performs the function of storing the halftoned image file M(x,y) during the printing process. Image memory 20 is in electronic communication with a controller 130.

As shown in FIGS. 1 and 2, from image memory 120, halftoned image file M(x,y) is next sent to the controller 130, which is connected to a waveform generator 140. Controller 130 controls electronic signals (not shown) generated by waveform generator 140. Waveform generator 140 controls the electronic signals such that electronic pulses comprising each electronic waveform obtain a predetermined pulse amplitude, pulse width and time interval between pulses. Waveform generator 140 can include an electronic circuit (not shown) for producing the desired electronic waveforms. That is, waveform generator 140 is used to provide proper signals that are used to actuate piezoelectric sidewalls 100*a/b* of individual nozzles 70. Movement of sidewalls 100*a/b* in turn ejects droplets 90 from ink nozzles 70. Image-wise activation of nozzles 70 and ink ejection of ink droplets 90 produces image 30 on receiver 40. More specifically, controller 130 performs the function of controlling electronic waveforms in order to obtain corresponding pixels with proper image density and pixel location for each image line. Controller 130 accomplishes this function by requesting that the electronic signal be generated by waveform generator 140 in order to lay-down a specific color of a specific density by a specific nozzle 70 and at a specific pixel location in image 30. However, in order to select an individual nozzle 70 for activation, a nozzle selector 150 interconnects waveform generator 140 and print head 20. Nozzle selector 150 selects individual nozzles 70 for activation in response to the waveform received from waveform generator 140, so that ink droplet 90 of proper density, location and color is ejected from nozzle 70. In case of a thermal ink jet print head (not shown) the electronic signal creates a desired heat pulse necessary to eject a desired number of drops out of the selected nozzles.

Referring again to FIG. 1, controller 130 is also connected to a first motor 160 for controllably translating print head 20 in a first direction along a guide rail 165 engaged by print head 20. In addition, controller 130 is connected to a reversible second motor 170 for controllably translating receiver 40 in a second direction orthogonal to the first direction of travel for print head 20. More specifically, second motor 170 may engage a plurality of rollers 175 that in turn engage receiver 40 for translating receiver 40.

Referring to FIGS. 1 and 3, image 30 comprises a plurality of image bands 180, each of which are made by firing selected printhead nozzles while first motor 160 is operated to scan printhead 20 across receiver 40 parallel to width "W", as illustrated in FIG. 3. During this time, receiver 40 is held stationary. The nozzles 70 of printhead 20 consist of a first nozzle, a last nozzle, and intermediate nozzles. Depending on positions of the nozzles while moving in the direction "L," the first nozzle may be nearest the top of the printed image (the part of the image printed first). Also, this is the part of the image made by the first of the image bands 180. After printing the first of the image bands 180, first motor 160 typically moves printhead 20 back to its initial position along one side of receiver 40. However, it is well known in the art to print along the "W" and/or the "L" direction. When printing along the "W" direction, return motion of printhead 20 is not required.

Referring again to FIGS. 1 and 3, before the next image band 180 is printed, receiver 40 is moved in a direction parallel to the line "L" in FIG. 3 by second motor 170, to allow printing of precisely spaced image bands 180 from the top to the bottom of receiver 40. Each image band 180 is thus distinct in that it is made when printhead 40 is located at a multiplicity of different positions along the direction marked "L" in FIG. 3. Preferably, the directions "W" and "L" are orthogonal, although this need not be the case. As is well known in the art, the distance receiver 40 is moved in a direction parallel to "L" in FIG. 3 may be equal to the distance in a direction parallel to "L" between the first and last nozzles in printhead 20 or may be less than this distance, depending upon whether or not the bands are to be overlapped. Overlapping bands are provided in commercial products to increase image quality, as is well known in the art.

However, it is important that receiver 40 advances a precise width. This width is often, but not always, an integral fraction of the nozzle to nozzle distance in order to provide an aesthetically pleasing print. According to the invention, precise advancement of receiver 40 is achieved by judicious placement and sensing of registration marks in border area 44 rather than by the use of a precision stepper motor.

Figure 4:
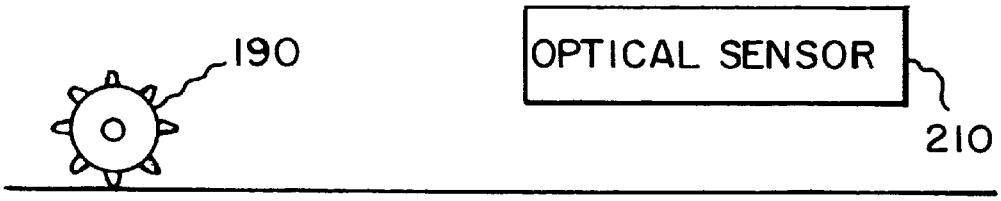
FIG. 4 is a view in elevation of a first embodiment marker for marking the receiver, such as by means of a dye.

Therefore, turning now to FIGS. 3 and 4, a marker 190 is disposed near print head 20 for forming a plurality of spaced-apart registration marks 200 in border area 44 of receiver 40. Marks 200 may preferably lay in a portion of border area 44 extending along length "L". An optical sensor 210 is disposed near print head 20 and is in sensing relationship to marks 200 for sensing marks 200. It will be understood that the terminology "marks" is defined herein to mean not only indicia printed onto receiver 40, but also indicia formed as perforations or embossments.

Referring to FIGS. 3 and 4, first embodiment marker 190 is adapted to form marks in optically readable dye and sensor 210 is adapted to optically sense the optically readable dye. Sensor 210 may transmit a light beam onto border area 44, so that as the light is intercepted by each mark 200, it is reflected therefrom and received by sensor 210. If marks 200 are more reflective than receiver 40, the presence of marks 200 is indicated by a larger amplitude of light striking sensor 210. If marks 200 are less reflective than receiver 40, the presence of marks 200 is indicated by a lower level or absence of light striking sensor 210. Alternatively a fluorescent dye which shifts wavelength or an infrared dye can used in making of marks 200. Sensor 210 may accurately detect the position of marks 200 in a variety of ways. For example, a magnified optical image of marks 200 or of a subset of marks 200 may be projected onto a CCD which measures light reflected at various portions of the dot (i.e., mark 200) and thereby provides data to image processor 60 as to location of mark 200 with respect to printhead 20. Alternatively, sensor 210 may itself be controllably positionable over a narrow range of distances and may in this mode be programmed to "lock on" to a particular mark, such as by optically aperturing registration mark 200 and continuously adjusting position of sensor 210 in order to maximize a signal representing the amount of light reflected through the aperture and onto a single optical detector. In any case, it is advantageous to the precise determination of the location of mark 200 that mark 200 be small and spatially well defined. That is, mark 200 is relatively small and spatially well defined, so that the amount of reflected light sensed by sensor 210 changes abruptly in the region of mark 200.

Figure 5:
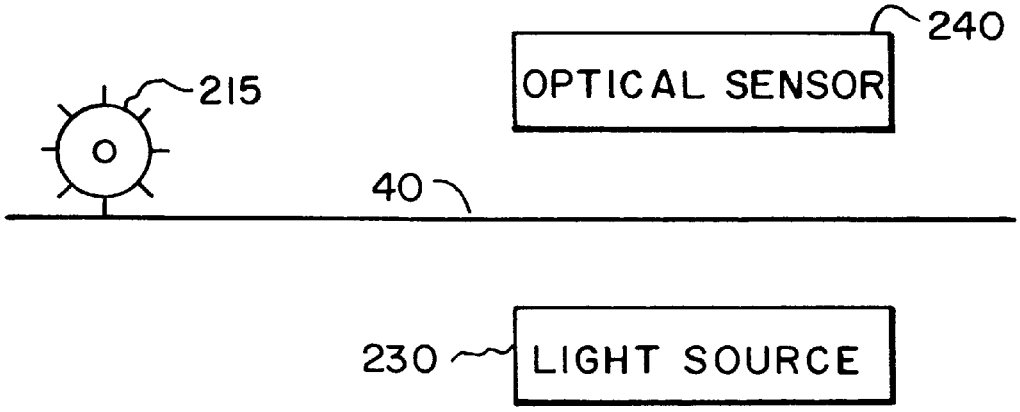
FIG. 5 is a view in elevation of a second embodiment marker for perforating the receiver to form the registration marks.
Figure 6:
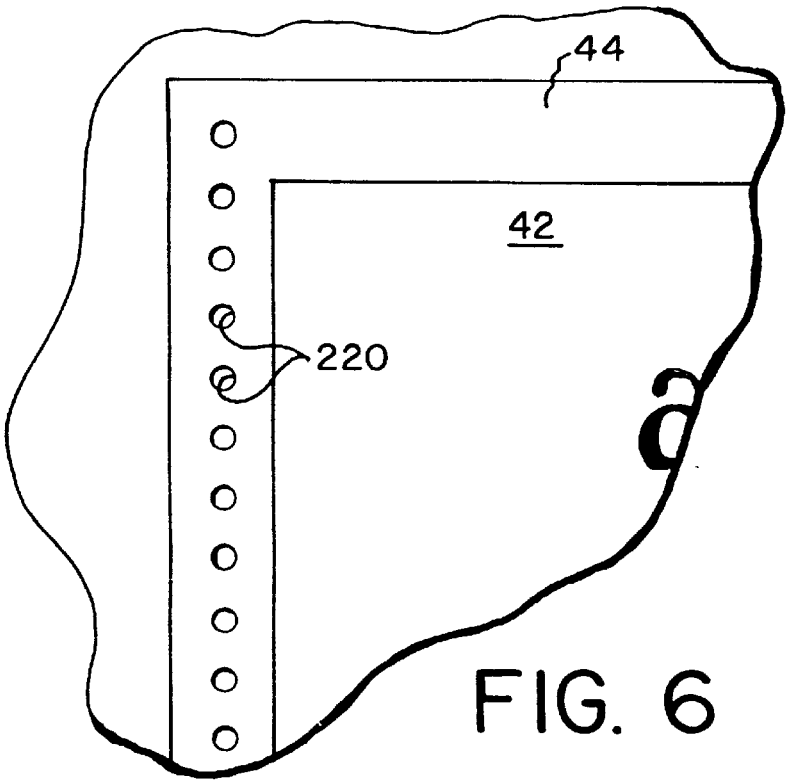
FIG. 6 is a fragmentation view in plan of the receiver having perforated registration marks therethrough.

Referring to FIGS. 3, 5 and 6, a second embodiment marker 215 may also form marks 200 as a plurality of holes 220 in border area 44. In order to detect these marks 200, sensor 210 may be a mechanical sensor for mechanically sensing each hole 220 by means of tactilely engaging each hole 220. Stylus sensors suitable for detection of these holes are well known in the art. Alternatively, holes 220 may be sensed by a light source 230 disposed to one side of receiver 40 and in alignment with border area 44 for emitting a light beam through each hole 220. An optical sensor 240 is disposed on an opposite side of receiver 40 and in alignment with light source 230 for optically sensing the light beam passing through holes 220.

Figure 7:
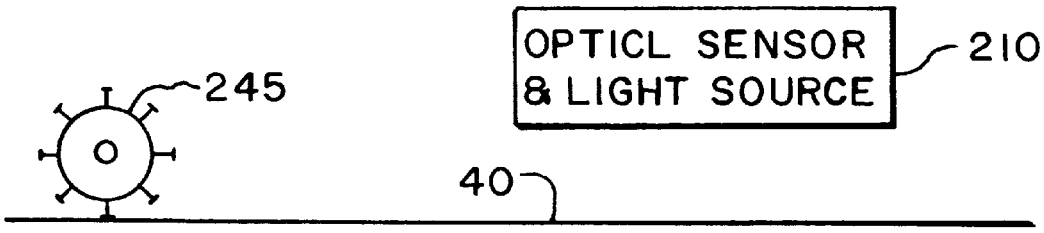
FIG. 7 is a view in elevation of a third embodiment marker for embossing the receiver to form the registration marks.
Figure 8:
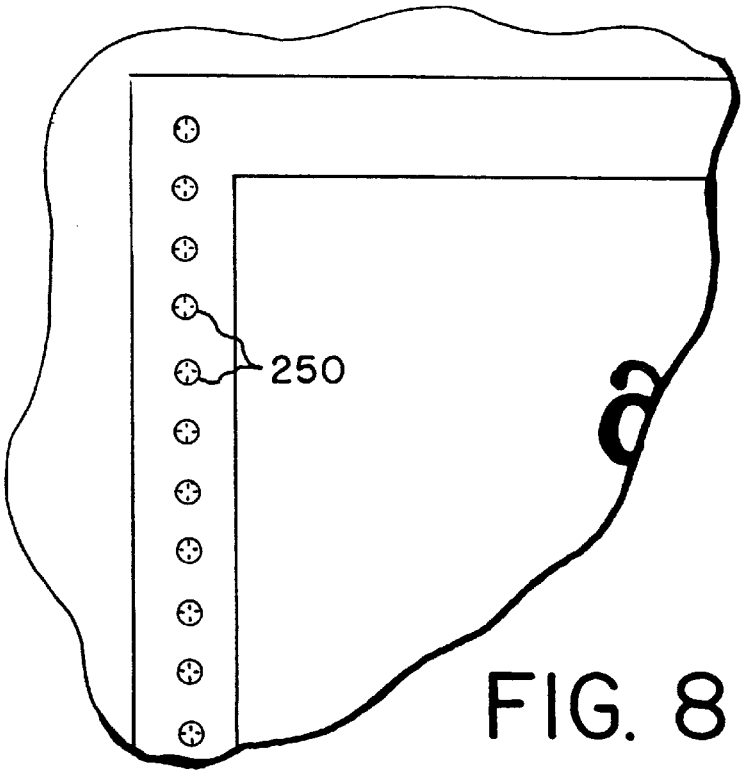
FIG. 8 is a fragmentation view in plan of the receiver having the registration marks embossed onto the receiver.

Referring to FIGS. 3, 7 and 8, a third embodiment marker 245 may form marks 200 as a plurality of embossments 250 in border area 44 of receiver 40. In this regard, sensor 210 may transmit a light beam of predetermined wavelength onto border area 44, so that as the light beam is intercepted by each embossment 250, it is reflected therefrom and received by sensor 210. An alternative method of detection of embossments 250 is the use of the previously mentioned stylus mechanical sensors.

As described more fully hereinbelow, registration marks 200 are used to register each image row 188 of image 30 in order to obtain an aesthetically pleasing color image 30 in image area 42. Moreover, use of printer 10 avoids need for a costly precision motor to translate receiver 40 along length "L" of image area 42.

In the preferred embodiment of the present invention, marker 190 may be adapted to form marks in a dye which is optically readable to sensor 210 in the manner described hereinabove. Thus, for example, marker 190 may itself comprise an array of ink jet nozzles, similar to the array shown in FIG. 2, which shows nozzles 70 comprising printhead 20. However, factors such as size of ink droplets 90, ink material from which droplets 90 are made, and location of the nozzles belonging to marker 190 may be optimized for allowing sensor 210 to accurately detect the location of marks formed by marker 190. For example, such optimization may be that the nozzles of marker 190 are relatively small and closely spaced. In this case, the material from which the drops are made is preferably rapidly absorbed into receiver 40 in order that marks on receiver 40 are small and closely spaced. Alternatively, the material from which the drops are made may be advantageously chosen to be of a type not at all absorbed by receiver 40, such as a hot melt wax to provide a mark with a very sharp, optically visible boundary. A very sharp optically visible boundary aids sensor 210 in precisely detecting location of mark 200. Thus, such a marking material can be used advantageously for establishing registration marks 200 in border area 44. Yet another type of material from which drops comprising marks 200 may be a "mixed phase" material to allowing precise detection of the location of the marks. Such a "mixed phase" material may comprise, for example, fluorescent beads of low concentration in a colorless carrier fluid, the number of such beads deposited at each mark being relatively few. Yet another type of material from which drops comprising marks 200 may be made, advantageous to allowing precise detection of the location of the marks, is a mixed phase material comprised of two fluids which are immiscible at room temperature, one of which is absorbed by receiver 40 and the other of which is not absorbed by receiver 40. The non-absorbed fluid contains dye visible to sensor 210. In this manner, volume of the phase remaining on the surface of receiver 40 and hence the size of mark 200 is controllably small and its boundaries well defined.

Referring to FIGS. 1 and 3, another variation of the invention is shown comprising, controller 130 controllably operates first motor 160, second motor 170, nozzle selector 150, and nozzles 70, so that selected ones of nozzles 70 of printhead 20 print spaced-apart marks 200 along the border area 44 of the receiver 40. Before printing the first image band 180 of image 30, selected nozzles 70 are instructed by controller 130 to print spaced-apart marks 200 along border area 44 of receiver 40. These marks thus appear in the border area over a distance of no more than the distance between the first and last nozzle in the direction parallel to "L" in FIG. 3. For example, marks 200 in the border area might be placed at intervals of every third nozzle of printhead 20.

Referring again to FIGS. 1 and 3, after first image band 180 is printed, receiver 40 is advanced by second motor 170 by an amount which is precisely determined, for example, by a feedback process comprising detection of marks 200 by sensor 210, determining position of printhead 20 with respect to receiver 40 and feeding that information through controller 130 to operate second motor 170, rollers 175 and printhead 20. It is well known in the art that by repeating these steps in a continuous fashion, receiver 40 may be advanced by a precise amount. After receiver 40 has been advanced to the location desired for printing of the second image band, but before second image band 180 is printed, a new set of marks 200 are printed on border area 44 of receiver 40. After second image band 180 is printed, the process of advancing receiver 40 by a precise amount is repeated. Sensor 210 or 240, as the case may be, senses new marks 200 and transmits that information to controller 130 which controls movement of print head 20, second motor 170 and rollers 175. In this manner, a plurality of image rows 188 are printed all in registration because receiver 40 is advanced a precise distance each time in order to prepare to print consecutive image rows 188.

It may be appreciated from the disclosure hereinabove, that an advantage of the present invention is that printer 10 provides the dual function of both marking receiver 40 and sensing marks 200/220/250 made on receiver 40, in order to achieve proper registration of all image bands forming image 30. This is so because printer 10 comprises marker 190 in combination with sensor 210/240 for both marking receiver 40 and sensing the marks made thereby, respectively.

It may be further appreciated from the disclosure hereinabove, that another advantage of the present invention is that use of a costly precision motor to translate the receiver is avoided. This is so because detection marks 200 together with second motor 170 are used to reposition receiver 40 rather than using a precision motor.

While the invention has been described with particular reference to its preferred embodiments, it will be understood by those skilled in the art that various changes may be made and equivalents may be substituted for elements of the preferred embodiments without departing from the invention. For example, marks 200 may be arranged in border area 44 so as to detect skew of receiver 40 as rollers 175 advance receiver 40.

Therefore, what is provided is an ink jet printer and method capable of forming a plurality of registration marks on a receiver and sensing the marks formed thereby to precisely translate the receiver in a manner avoiding use of a precision motor.

PARTS LIST

L . . . length of image area
W . . . width of image area

10 . . . printer
20 . . . print head
30 . . . image
40 . . . receiver
42 . . . image area
44 . . . border area
46 . . . ink reservoir
48 . . . conduit
50 . . . image source
60 . . . image processor
70 . . . nozzles
80 . . . ink chamber
90 . . . ink droplet
100*a/b* . . . sidewalls
110 . . . image halftoning unit
120 . . . image memory
130 . . . controller
140 . . . waveform generator
150 . . . nozzle selector
160 . . . first motor
165 . . . guide rail
170 . . . second motor
175 . . . rollers
180 . . . image bands
188 . . . image row
190 . . . marker
200 . . . registration marks
210 . . . sensor
215 . . . second embodiment marker
220 . . . holes
230 . . . light source
240 . . . optical sensor
245 . . . third embodiment marker
250 . . . embossments

What is claimed is:

1. An ink jet printer capable of forming a plurality of registration marks on a receiver and sensing the marks formed thereby, comprising:

(a) a print head for printing a plurality of lines comprising a band of image information, including a first line and a last line, across a width-wise dimension of the receiver in a single pass to form a portion of an image on the receiver, the receiver having an image area for receiving the image therein and a border area adjacent to the image area;

(b) a marker disposed near said print head for forming the plurality of registration marks in the border area, the plurality of marks extending along a length-wise dimension of the image, adjacent registration marks in the length-wise dimension being spaced closer than a spacing between the first and last lines of image information;

(c) a sensor disposed near said print head and in sensing relationship to the registration marks for sensing the registration marks; and (d) a controller that adjusts position of the receiver relative to the printhead in the length-wise dimension direction of the printhead in response to sensing of the registration marks.

2. The printer of claim 1, (a) wherein said marker forms the marks in optically readable dye; and (b) wherein said sensor is an optical sensor for optically sensing the optically readable dye.

3. The printer of claim 1, a) wherein said marker forms the marks in optically readable hot wax ink; and (b) wherein said sensor is an optical sensor for optically sensing the optically readable hot wax ink.

4. The printer of claim 1, (a) wherein said marker forms the marks by printing an ink including two immiscible phases, at least one of the phases containing an optically readable dye; and (b) wherein said sensor is an optical sensor for optically sensing the optically readable dye in the at least one phase.

5. The printer of claim 1, (a) wherein said marker forms the marks in optically readable infrared dye; and (b) wherein said sensor is an optical sensor for optically sensing the infrared optically readable dye.

6. The printer of claim 1, (a) wherein said marker forms the marks in optically readable dye containing a plurality of fluorescent particles; and (b) wherein said sensor is an optical sensor for optically sensing the fluorescent particles.

7. The printer of claim 1, (a) wherein said marker forms the marks as holes; and (b) wherein said sensor is a mechanical sensor for mechanically sensing the holes.

8. The printer of claim 1, (a) wherein said marker forms the marks as holes; and (b) wherein said sensor is an optical sensor for optically sensing a light beam passing through the holes.

9. The printer of claim 8, further comprising a light source aligned with said sensor and disposed so as to pass the light beam through the holes and to said sensor.

10. The printer of claim 1, (a) wherein said marker forms embossed marks; and (b) wherein said sensor is an optical sensor for optically sensing the embossed marks.

11. The printer of claim 1, (a) wherein said marker forms embossed marks; and (b) wherein said sensor is a mechanical sensor for mechanically sensing the embossed marks.

12. An ink jet printer capable of forming a plurality of registration marks on a receiver and sensing the marks formed thereby, comprising:

(a) a print head for printing an image of a predetermined length on the receiver, the receiver having an image area for receiving the image and a border area surrounding the image area, the image being defined by a multiplicity of image bands each band defined by a plurality of image rows printable by said print head, the rows including a first row and a last row of a band;

(b) a plurality of nozzles formed in said print head, each nozzle capable of being individually selected for activation and having an ink body thereat ejectable from said nozzle as said nozzle is selected for activation;

(c) a nozzle selector connected to said nozzles for individually selecting said nozzles for activation;

(d) a print head transport mechanism engaging said print head for moving said print head in a first direction with respect to the receiver, so that said print head prints each band of image rows;

(e) a receiver transport mechanism disposed near said print head and engaging the receiver for moving the receiver in a second direction orthogonal the first direction;

(f) a controller connected to said nozzle selector for controlling said nozzle selector, and connected to said print head transport mechanism for controlling said print head transport mechanism, and connected to said receiver transport mechanism for controlling said receiver transport mechanism, whereby individual ones of said nozzles are controllably selected for activation as said controller controls said nozzles, whereby said print head transport mechanism controllably moves in the first direction as said controller controls said print head transport mechanism, and whereby said receiver transport mechanism controllably moves said receiver in the second direction as said controller controls said receiver transport mechanism;

(g) a marker disposed near said print head for forming the plurality of registration marks in at least a portion of the border area, the marks extending in the length-wise direction of the length of the image, adjacent marks spaced in the length-wise direction a distance less than a spacing between the first and last rows of the band; and (h) a sensor disposed near said print head and in sensing relationship to the marks for sensing the marks and for generating a signal indicative of the marks sensed thereby, said sensor being connected to said controller for transmitting the signal to said controller, so that said controller controls said nozzle selector and said print head control transport and said receiver control transport in response to the signal transmitted to said controller.

13. The printer of claim 12, (a) wherein said marker forms the marks in optically readable dye; and (b) wherein said sensor is an optical sensor for optically sensing the optically readable dye.

14. The printer of claim 12, (a) wherein said marker forms the marks in optically readable hot wax ink; and (b) wherein said sensor is an optical sensor for optically sensing the optically readable hot wax ink.

15. The printer of claim 12, (a) wherein said marker forms the marks by printing an ink including two immiscible phases, at least one of the phases containing an optically readable dye; and (b) wherein said sensor is an optical sensor for optically sensing the optically readable dye.

16. The printer of claim 12, (a) wherein said marker forms the marks in optically readable infrared dye; and (b) wherein said sensor is an optical sensor for optically sensing the infrared optically readable dye.

17. The printer of claim 12, (a) wherein said marker forms the marks in optically readable dye containing a plurality of fluorescent particles; and (b) wherein said sensor is an optical sensor for optically sensing the fluorescent particles.

18. The printer of claim 12, (a) wherein said marker forms the marks as holes; and (b) wherein said sensor is a mechanical sensor for mechanically sensing the holes.

19. The printer of claim 12, (a) wherein said marker forms the marks as holes; and (b) wherein said sensor is an optical sensor for optically sensing a light beam passing through the holes.

20. The printer of claim 19, further comprising a light source aligned with said sensor and disposed so as to pass the light beam through the holes and to said sensor.

21. The printer of claim 12, (a) wherein said marker forms embossed marks; and (b) wherein said sensor is an optical sensor for optically sensing the embossed marks.

22. The printer of claim 12, (a) wherein said marker forms embossed marks; and (b) wherein said sensor is a mechanical sensor for mechanically sensing the embossed marks.

23. A method of printing with an ink jet printer comprising the steps of:

(a) printing a plurality of lines of image information comprising a only a band portion of an image on a receiver during relative movement of an ink jet printhead with the receiver, the plurality of lines including a first line and a last line of the band portion, which band portion is only a small portion of the image to be printed on the receiver;

(b) forming a plurality of registration marks on the receiver, the plurality of registration marks arranged in a length-wise direction of the receiver, the plurality of marks being formed during advancement of the receiver in the length-wise direction and adjacent registration marks being spaced closer in the length-wise direction than a spacing between the first and last lines of the band portion of the image; and (c) sensing the registration marks and adjusting printing of a next band portion of the image in response to sensing of a registration mark.

24. The method of claim 23, (a) wherein the registration marks are formed in optically readable dye; and (b) wherein an optical sensor senses the optically readable dye.

25. The method of claim 23, (a) wherein the marks are formed by printing with an optically readable hot wax ink; and (b) wherein an optical sensor senses the optically readable hot wax ink.

26. The method of claim 23, (a) wherein the marks are formed by printing using an ink that includes two immiscible phases, at least one of the phases containing an optically readable dye.

27. The method of claim 23, (a) wherein the marks are formed using an optically readable infrared dye; and (b) wherein a sensor senses the infrared of the optically readable dye.

28. The method of claim 23, (a) wherein the marks are formed using an optically readable dye containing a plurality of fluorescent particles; and (b) wherein an optical sensor senses the fluorescent particles.

29. The method of claim 23, comprising the steps of:

(a) forming the marks as holes; and (b) mechanically sensing the holes.

30. The method of claim 23, comprising the steps of:

(a) forming the marks as holes; and (b) optically sensing a light beam passing through the holes.

31. The method of claim 23, (a) wherein the marks are formed as embossed marks; and (b) wherein an optical sensor senses the embossed marks.

32. The method of claim 23, (a) wherein the marks are formed as embossed marks; and (b) wherein a mechanical sensor mechanically senses the embossed marks.

33. A method of operating an ink jet printer, comprising the steps of:

(a) operating an ink jet printhead and printing an image of predetermined length in a length-wise direction of a receiver, the receiver having an image area for receiving the image therein and a border area adjacent to the image area;

(b) forming a plurality of registration marks in the border area during movement of the receiver in the length-wise direction thereof, the plurality of marks arranged in the length-wise direction of the receiver;

(c) disposing a CCD sensor near the print head and in sensing relationship to the marks for sensing the marks; and (d) sensing the marks and adjusting printing of a next portion of the image on the receiver in response to the sensing.

34. The method of claim 33 and wherein the printhead prints a plurality of lines of image information on the receiver during a single pass of the printhead relative to the receiver in a direction transverse to the length-wise direction thereof, the plurality of lines forming a band portion of the image that is substantially less than the entire image and the plurality of lines including a first line and a last line, the spacing between adjacent marks in the length-wise direction being less than the spacing between the first line and the last line.

* * * * *